US011149490B2

(12) United States Patent
Nicolosi et al.

(10) Patent No.: US 11,149,490 B2
(45) Date of Patent: Oct. 19, 2021

(54) BOXES FOR BLINDS

(71) Applicant: Pellini S.p.A., Codogno (IT)

(72) Inventors: Giovanni Nicolosi, Dresano (IT); Alessandro Pellini, Codogno (IT)

(73) Assignee: PELLINI S.P.A., Codogno (IT)

( * ) Notice: Subject to any disclaimer, the term of this patent is extended or adjusted under 35 U.S.C. 154(b) by 284 days.

(21) Appl. No.: 16/333,960

(22) PCT Filed: Sep. 17, 2017

(86) PCT No.: PCT/IB2017/055650
§ 371 (c)(1),
(2) Date: Mar. 15, 2019

(87) PCT Pub. No.: WO2018/051309
PCT Pub. Date: Mar. 22, 2018

(65) Prior Publication Data

US 2019/0203531 A1 Jul. 4, 2019

(30) Foreign Application Priority Data

Sep. 19, 2016 (IT) ..... 102016000093933

(51) Int. Cl.
*E06B 9/323* (2006.01)
*E06B 9/303* (2006.01)
(Continued)

(52) U.S. Cl.
CPC ..... *E06B 9/323* (2013.01); *E06B 9/264* (2013.01); *E06B 9/303* (2013.01); *E06B 9/322* (2013.01);
(Continued)

(58) Field of Classification Search
CPC ..... E06B 9/323; E06B 9/264; E06B 9/266; E06B 9/42; E06B 2009/2643; E06B 9/17023; E06B 9/17015; E06B 9/324
See application file for complete search history.

(56) References Cited

U.S. PATENT DOCUMENTS

| | | | | |
|---|---|---|---|---|
| 6,038,816 | A | 3/2000 | Park | |
| 6,293,330 | B1 * | 9/2001 | Ciuca | E06B 9/323 160/176.1 R |
| 6,382,296 | B1 * | 5/2002 | Judkins | E06B 9/323 160/178.1 R |
| 2004/0221970 | A1 * | 11/2004 | Nien | E06B 9/323 160/173 R |

(Continued)

FOREIGN PATENT DOCUMENTS

| | | | |
|---|---|---|---|
| BE | 501 492 | A | 3/1951 |
| DE | 20 2007 010768 | U1 | 12/2007 |

(Continued)

OTHER PUBLICATIONS

International Search Report and Written Opinion dated Nov. 10, 2017, in corresponding PCT Application No. PCT/IB2017/055650 (12 pages).

*Primary Examiner* — Daniel P Cahn
*Assistant Examiner* — Matthew R. Shepherd
(74) *Attorney, Agent, or Firm* — MH2 Technology Law Group, LLP

(57) ABSTRACT

A box for a system for opening and closing a communication route between two separate areas, the system including separation means suitable for allowing and preventing, respectively, at least partially, crossing of the route by light, may include: a box body configured to accommodate a movement unit of the system; and support elements for the movement unit. The box body may have a major extension direction. The box body may be defined by support and closing profiles, both extending along the direction. The support profile may define at least one upper, lower, and connecting wall. The closing profile may define a closing wall. The closing profile may be removably fixable to the
(Continued)

support profile for closing the box body. When the closing profile is fixed to the support profile, a distance between the closing wall and the connecting wall may be less than or equal to 20 millimeters.

20 Claims, 4 Drawing Sheets

(51) Int. Cl.

| | |
|---|---|
| ***E06B 9/264*** | (2006.01) |
| ***E06B 9/322*** | (2006.01) |
| *E06B 9/42* | (2006.01) |
| *E06B 9/266* | (2006.01) |

(52) U.S. Cl.
CPC ..... *E06B 9/266* (2013.01); *E06B 9/42* (2013.01); *E06B 2009/2643* (2013.01); *E06B 2009/2646* (2013.01)

(56) References Cited

U.S. PATENT DOCUMENTS

| | | | | |
|---|---|---|---|---|
| 2005/0173077 | A1* | 8/2005 | Nicolosi | E06B 9/327 160/84.02 |
| 2006/0060306 | A1* | 3/2006 | Lukos | E04F 10/0662 160/22 |
| 2009/0056885 | A1* | 3/2009 | Garmyn | E06B 9/42 160/323.1 |
| 2011/0308748 | A1* | 12/2011 | Brignatz | E06B 9/323 160/368.1 |
| 2014/0246156 | A1* | 9/2014 | Dorny | E06B 9/303 160/172 R |
| 2014/0305601 | A1* | 10/2014 | Mullet | E06B 9/42 160/170 |
| 2016/0222721 | A1* | 8/2016 | Rettig | E06B 9/262 |

FOREIGN PATENT DOCUMENTS

| | | |
|---|---|---|
| EP | 1 882 805 A2 | 1/2008 |
| EP | 2 628 884 A2 | 8/2013 |

* cited by examiner

BOXES FOR BLINDS

CROSS-REFERENCE TO RELATED APPLICATION(S)

This application is a national stage entry from International Application No. PCT/IB32017/055650, filed on Sep. 19, 2017, in the Receiving Office ("RO/IB") of the International Bureau of the World Intellectual Property Organization ("WIPO"), and published as International Publication No. WO 2018/051309 A1 on Mar. 22, 2018; International Application No. PCT/IB2017/055650 claims priority from Italian Patent Application No. 102016000093933, filed on Sep. 19, 2016, in the Italian Patent and Trademark Office ("IPTO"), the entire contents of all of which are incorporated herein by reference.

FIELD OF APPLICATION OF THE INVENTION

The present invention relates to the sector of movable structures by means of which it is possible to mutually separate two areas, or it is possible to at least partially prevent the passage by light or persons through an opening in a wall separating two separate areas.

Among movable structures belonging to this type, by way of example, blind or shutter type closing systems are included.

Below, the expression "closing system" in the present description means all movable structures of the aforesaid type.

More specifically, the present invention relates to a box for a "closing system" of the type mentioned above.

Such box is usefully used in double panes intended for the thermal and light insulation of buildings, but it may also be used outside the double panes itself or the frame of a window.

BACKGROUND ART

The use of a box for a "closing system" is known in the background art. Such box comprises a box body configured to accommodate the movement unit of the "closing system" such as, for example, a venetian blind or pleated blind.

In detail, the box body has a major extension direction, that is to say it has a shape which is elongated in such major extension direction. The box body has a parallelepiped shape and comprises a front wall, a rear wall, an inner wall and an outer wall. The upper wall is removable so as to allow the insertion of the roller, its supports and their movement members during assembly. Since such boxes are generally intended to be inserted in double panes which usually comprise a frame consisting of one or more spacer elements mounted on the sides of the chamber defined between two sheets of glass in order to keep the latter offset from each other and to prevent the leaking of gases along the edges. The spacer elements are connected to one another with convenient angular elements, or alternatively they may be obtained with a single element folded in the manner of a closed frame.

Such double panes therefore define a gap which transverse size is defined as the distance between the facing surfaces of two glass sheets. Therefore, the box must be selected on the basis of the size of the gap of the double panes itself.

Recently, interest is emerging in inserting, in existing double panes without a blackout blind, a "closing system", such as, for example, a venetian blind or pleated blind.

For economic reasons, it is preferable to perform such operation without having to replace doors and windows. This results in the "closing system" requiring measurements that are compatible with the ones of the existing double panes.

Disadvantageously, the double panes for which the "closing system" is to be inserted has an extremely limited useful gap for installation, and the box assembly system used to date does not allow the insertion of blind components for transverse sizes less than 20 mm.

Accordingly, it is disadvantageous to assemble known boxes in double panes having such size or smaller sizes, making it impossible to improve such double panes.

An example of boxes for such closing systems is described in documents of prior art BE501492, US 2014/305601, EP 2628884 and DE 20200701076801.

SUMMARY OF THE INVENTION

In this context, the technical task at the basis of the present invention is to propose a box for a "closing system" which overcomes the above-mentioned drawbacks of the known technique.

In particular, it is the object of the present invention to make available a box for a "closing system" capable of being inserted in double panes of any size.

The technical task identified, and objects specified are substantially achieved by a box for a "closing system" comprising the technical features explained in one or more of the appended claims.

In particular, one embodiment of a box for a "closing system" according to the present invention comprises a box body configured to accommodate a movement unit of the "closing system". The box body has a major extension direction and is defined by a support profile and by a closing profile extending along such major extension direction.

The box body has at least one upper wall, a lower wall, a connecting wall and a closing wall. The connecting, upper and lower walls are defined by the support profile. The closing wall is defined by the closing profile.

The closing profile is fixable to the support profile to close the box body. The lower wall has a plurality of slots configured to each receive a respective support element for the movement unit of the "closing system".

Advantageously, opening the box at the closing wall, which is transverse with respect to the upper and lower walls, allows inserting the movement unit comprising among other things, a roller and/or at least one drum and relative ropes and/or ladders required to easily move the blind in the box, regardless of the transverse size of the box itself. It is therefore possible to make boxes of any size, even more narrow boxes than the ones known from the background art.

Optionally, when the closing profile is fixed to the support profile, the distance between the closing wall and the connecting wall is equal to or less than 20 mm.

Optionally, the box may comprise at least one support element for a roller of a blackout blind. Such support element has a base configured to abut on the lower wall of the box body. Such support element comprises a projection projecting from the base and configured to be inserted into the slot of the lower wall and to lock the sliding of the support element along the lower wall.

LIST OF DRAWINGS

Further features and advantages of the present invention shall be more apparent from the indicative, and therefore non-limiting, description of a preferred, but not exclusive, embodiment of a box for a blackout blind, as illustrated in the accompanying drawings, in which.

DETAILED DESCRIPTION

Figures 1, 1A:
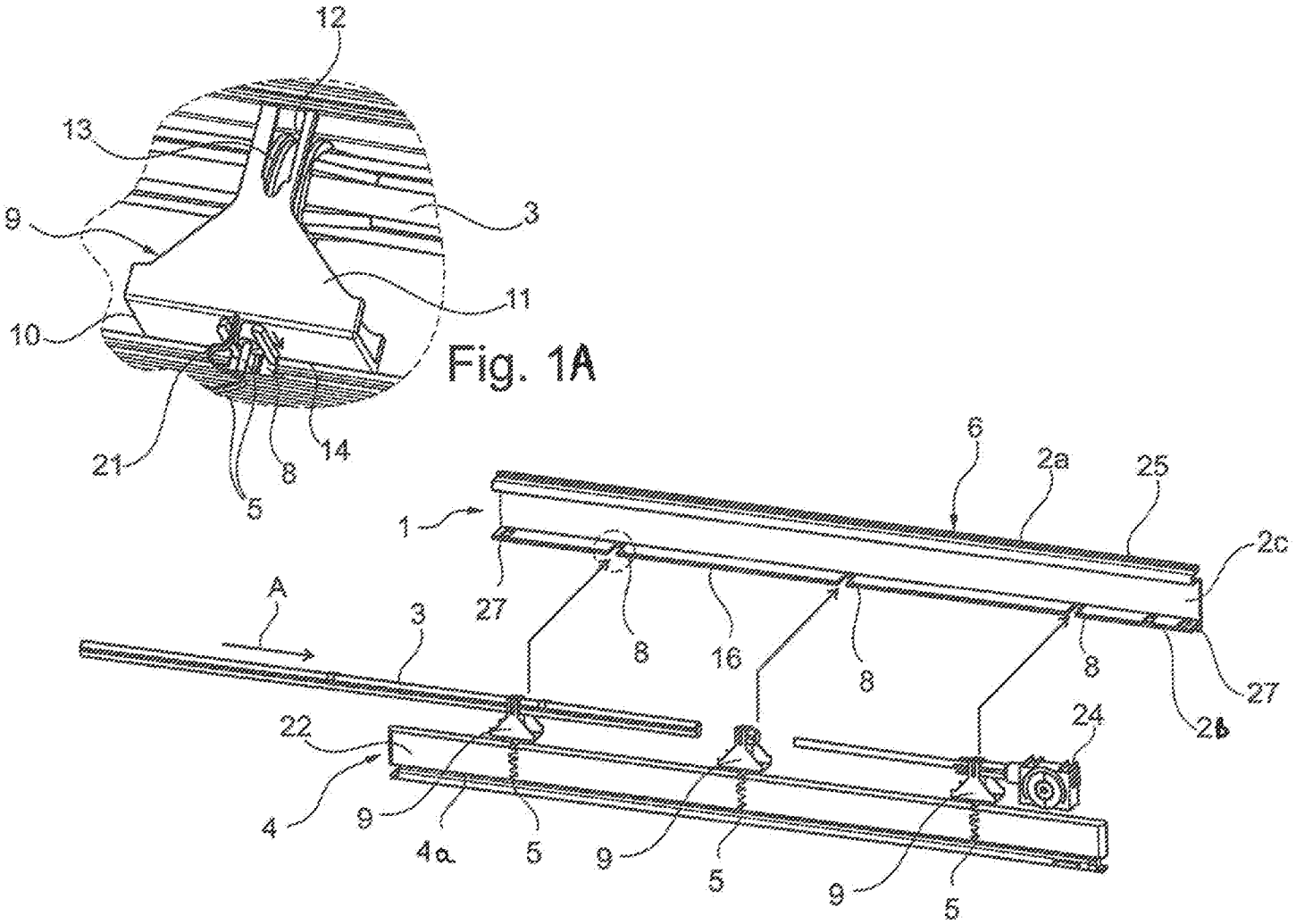
FIG. 1 is a perspective view of a box for blackout blinds according to the present invention, in a first mounting step.
FIG. 1A is an enlarged view of a detail of the box in FIG. 1, in a first mounting step.

With reference to the accompanying drawings, 1 indicates a box for a "closing system" 4 according to the present invention.

The system for opening and closing 4 a communication route between two separate areas comprises separation means 4*a* suitable for allowing, and respectively preventing, at least partially, the crossing of said route by light.

For example, the separation means 4*a* materialize in a blackout blind, a venetian blind, or a pleated blind.

The "closing system" 4 comprises a movement unit 3 for moving the separation means 4*a* between at least a first open position and a second position for closing or opening such route.

The box 1 comprises a box body 2 and in particular, the movement unit 3 is insertable into the box body 2 of the box 1.

According to a preferred embodiment, the movement unit 3 comprises a roller and/or at least one drum, and also a plurality of ropes and/or ladders 5 which are active on the separation means 4*a* and rolling onto the roller and/or drum for moving the separation means 4*a* themselves.

In particular, the box body 2 has a major extension direction "A". In other words, the box body 2 has a size along the major extension direction "A" which is much greater than the sizes in the plane perpendicular to the major extension direction "A". In other words again, the box body 2 has an elongated shape in the major extension direction "A". The box body 2 has substantially the shape of a parallelepiped extended along the major extension direction "A".

In greater detail, the box body 2 is defined by a support profile 6 and by a closing profile 7. Such profiles 6, 7 extend mainly along the major extension direction "A" of the box body 2. As shown in particular in FIG. 3, the closing profile 7 is fixable, that is in removable manner, to the support profile 6 to close the box body 2.

The profiles 6, 7 have a constant section along the major extension direction "A".

Moreover, the profiles 6, 7 may be made of aluminium.

According to an advantageous embodiment of the invention, the support profile 6 and/or the closing profile 7 are made of PVC or a combination of aluminium and PVC. Thereby, it is avoided to make heat bridges in the case in which the box comes into contact when in use, with the surfaces of glass or of the frame of the double panes, so as to simplify the use of the box 1 in a thermally insulating double panes.

The box body 2 also comprises at least one upper wall 2*a*, a lower wall 2*b*, a connecting wall 2*c* and a closing wall 2*d*. In detail, the connecting 2*c*, upper 2*a* and lower 2*b* walls are defined by the support profile 6. In other words, the connecting 2*c*, upper 2*a* and lower 2*b* walls are integrally made with the support profile.

The closing wall 2*d* is defined by the closing profile 7.

Moreover, the lower wall 2*b* has a contact edge 16 configured to abut on the closing wall 2*d* during mounting.

According to a particularly advantageous embodiment of the invention, when the closing profile 7 is fixed to the support profile 6, that is to say when the box 1 is assembled, the distance between the closing wall 2*d* and the connecting wall 2*c* is equal to or less than 20 mm.

It is however worth noting that in alternative embodiments of the invention, the distance between the closing wall 2*d* and the connecting wall 2*c* may be any distance. Greater details on the walls 2*a*, 2*b*, 2*c*, 2*d* and on the assembly of the box body 2 will be provided in a later part of the present description.

A pair of plugs 15, arranged transversely and preferably perpendicularly with respect to the major extension direction "A", close the box body 2 at the two opposite ends of the profiles 6, 7. Such plugs 15 have a portion which is insertable into the box body 2 and are each provided with a respective engagement member (not illustrated) which is insertable into a further slot 27 of the lower wall 2*b* of the box body 2 to lock the plug 15 into the seat.

The box 1 comprises also at least one support element 9 for the above-mentioned movement unit 3. Such support element 9 has a base 10 configured to abut on the lower wall 2*b* of the box body 2. A pair of uprights 11 extends from the base 10 and they define a seat 12 in which there is inserted a bushing 13 which, in use, surrounds the roller or the drum of the movement unit 3 and rotates integrally therewith inside the seat 12.

The support element 9 further comprises a projection 14 projecting from the base 10, in particular in direction which is opposite to the uprights 11.

The support element 9 has an opening 21 at the base 10, and in particular at the projection 14. Such an opening 21 serves the function of allowing the passage of one or more ropes and/or ladders 5 of the separation means 4*a* from the outside of the box body 2 towards the inside of the box body 2.

The lower wall 2*b* of the box body 2 has a plurality of slots 8 for receiving the support elements 9. Such slots 8 are conveniently distributed along the major extension direction "A", Such slots 8 are configured to each receive a respective support element 9 for the movement unit 3. In particular, the projection 14 of each support element 9 is configured to be inserted into the slot 8 and to lock the sliding of the support element 9 along the lower wall 2*b*. It is worth noting that the above-mentioned opening 21 is, in use, at the respective slot 8.

The box 1 comprises a plurality of support elements 9, in particular it comprises a number of support elements 9 equal to the number of slots 8.

It is worth noting that the above-mentioned contact edge 16 is discontinuous at the slots 8. In other words, the slots 8 are open at the contact edge 16 so as to allow the insertion of the projection 14 as shown for example, in FIG. 1A.

Figure 3B:
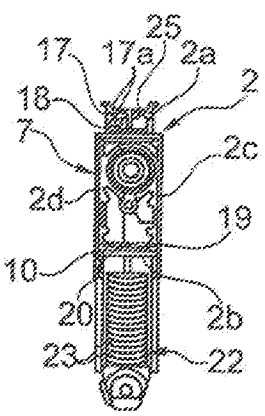
FIGS. 3A and 3B are sectional views of the box in FIGS. 1 and 2, in the mounting step in FIG. 3.
Figure 3A:
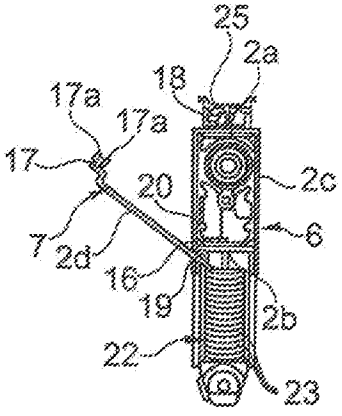

With reference in particular to FIGS. 3A and 3B, the closing al 2*d* has an engagement edge 17, The upper wall 2*a* at least partly defines a receiving seat 18 for such engagement edge 17. The engagement edge 17 is insertable into the receiving seat 18 to engage the closing wall 2*d* to the upper wall 2*a*.

Preferably, such engagement is obtained by means of an elastic bending of hooks 17*a* which extend from the engagement edge 17 transversely with respect to the closing wall 2*d*, in particular in direction of the upper wall 2*a*. In other words, the hooks 17*a* obtain a snap-in type joining between the closing wall 2*d* and the upper wall 2*a*.

The closing wall 2*d* also has an engagement edge 19, in particular opposite to the above-described engagement edge 17. Such engagement edge 19 is configured to engage a projecting portion 20 of the lower wall 2*b*.

The box 1 may optionally comprise a grip portion 25 fixed to the upper wall 2*a* and configured to be engaged by an upper element 26 which in turn can be associated, for example, with a frame of double panes (not illustrated). Such grip portion 25 is in particular integrally made with the upper wall 2*a*, that is to say it is part of the support profile 6 of the box 1. Such grip portion 25 acts in conjunction with the upper wall 2*a* to define the above-mentioned receiving seat 18 for the engagement edge 17. In detail, such grip portion has a transverse "T-shaped" section, where the upper portion is arranged substantially parallel to the upper wall 2*a*.

It is worth noting that since the grip portion 25 is integrally made with the upper wall 2*a*, it also ensures the complete closing of the box 1 so as to protect the components accommodated in the box from impurities and dirt. Such advantage can obviously be verified should the box be installed outside the double panes.

The aforesaid feature according to which the grip portion 25 is integrally made with the upper wall 2*a* facilitates also the fastening of the box to the support of the double panes in a more secure and easier manner.

The assembly of the box 1 with the closing system 4 occurs in the following manner.

Firstly, the separation means 4*a* is assembled in closed configuration. In the case illustrated, reference is made to a venetian blind comprising a blackout element 22 defined by a plurality of blades 23 tied to one another by ropes and ladders 5, in a per se known manner and therefore not described.

With reference to FIG. 1, the ropes 5 are wound onto the roller and drums of the movement unit 3 or optionally, onto drums of the movement unit 3 alone. The movement unit 3 is inserted into the bushings 13 of the support elements 9.

At this point, the separation means 4*a* has been assembled outside the box 1.

Then, the support elements 9 and the relative components associated therewith (separation means 4*a*, roller, drums, ropes, ladders, etc.) are positioned on the support profile 6 of the box 1, in particular by inserting the projections 14 into the respective slots 8 made on the lower wall 2*b*.

Possible movement means 24, for example, with magnetic mating, are then connected to the movement unit 3 in a per se known manner.

Figure 2:
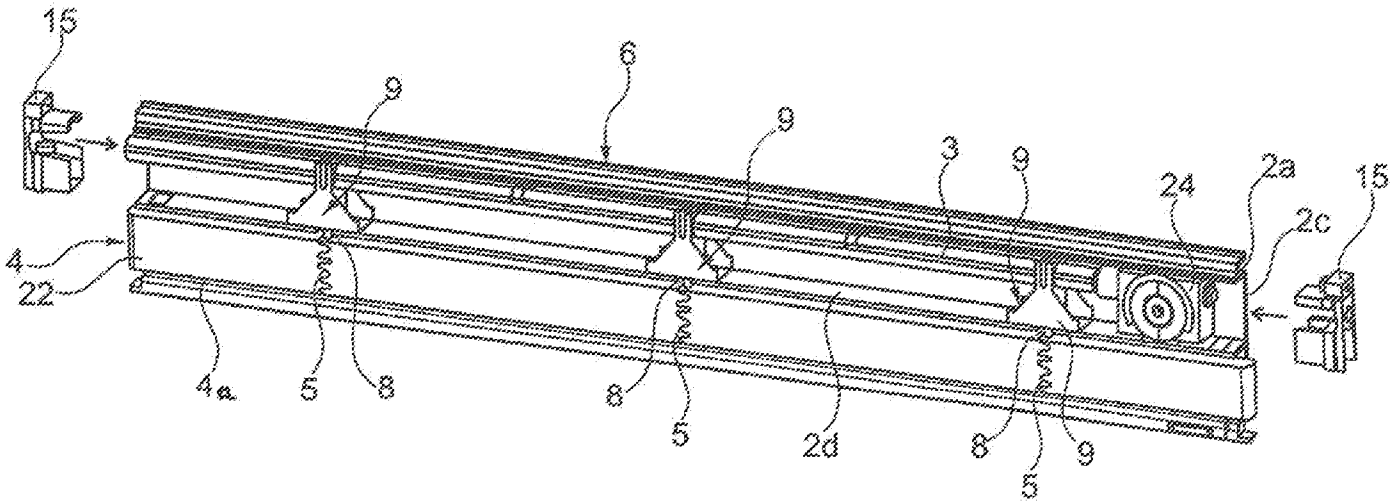
FIG. 2 is a perspective view of the box in FIG. 1, in a second mounting step.

The end plugs 15 are then positioned, as shown in FIG. 2. Such plugs 15 are locked to the lower wall 2*b* of the box body 2 to provide support to the movement unit itself.

At this point, the closing system 4 is inserted into the volume defined by the box.

Figure 3:
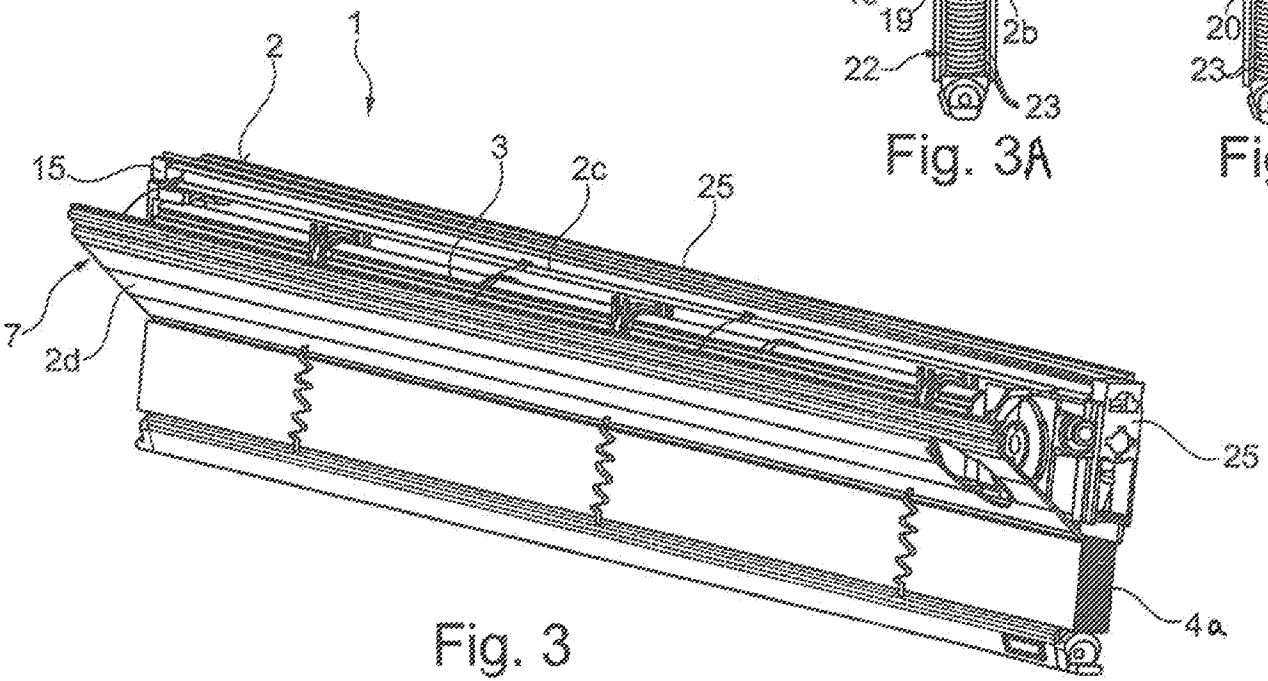
FIG. 3 is a perspective view of the box in FIGS. 1 and 2, in a third mounting step.

Then, in reference to FIGS. 3 and 3A, the closing profile 7 is fixed to the support profile 6 so as to encapsulate the closing system 4.

In detail, the engagement edge 19 of the closing wall 2*d* comes into contact with the lower wall 2*b*, in particular by engaging the projecting portion 20 of the lower wall 2*b*. The closing wall 2*d* is therefore caused to rotate as illustrated in FIG. 3A and, by exerting a slight pressure sufficient to slightly bend the hooks 17*a*, the engagement edge is snap-locked in the receiving seat 18 made at the upper wall 2*a*.

Figure 4:
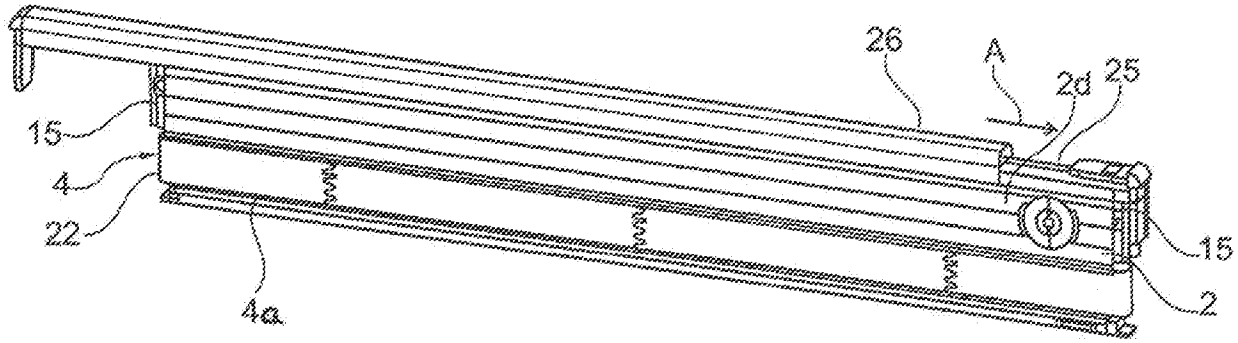
FIG. 4 is a perspective view of the box in FIGS. 1 and 2, in a fourth mounting step.

Optionally as shown in FIG. 4, in a successive step, the upper element 26 of the double panes may be inserted into the grip portion 25.

The box 1 and the movement unit 3 are ready for a possible insertion into the gap in double panes.

Obviously, in order to meet contingent and specific needs, those skilled in the art may make several modifications to the box for a system for opening and closing a communication route between two separate areas described above, all however contained within the scope of protection as defined by the following claims.

The invention claimed is:

1. A box for a system for opening and closing a communication route between two separate areas, the system comprising separation means suitable for allowing and preventing, respectively, at least partially, crossing of the communication route by light, the box comprising a box body configured to accommodate a movement unit of the system for opening and closing the communication route, the box body having a major extension direction and being defined by a support profile and by a closing profile extending along the major extension direction, the box body further having at least one upper wall, a lower wall, a connecting wall, and a closing wall, the connecting wall, the at least one upper wall, and the lower wall being defined by the support profile, the closing wall being defined by the closing profile, the closing profile being removably fixable to the support profile for closing the box body, the lower wall having a contact edge configured to abut the closing wall, the box further comprising support elements for the movement unit, each of the support elements having a base abutting the lower wall and a projection projecting from the base, the lower wall further having a plurality of slots, each of the slots having an open side at the contact edge so as to allow each projection to be inserted in a respective slot from the open side, by moving the projection in a direction toward the connecting wall, and wherein when the closing profile is fixed to the support profile, a distance between the closing wall and the connecting wall is less than or equal to 20 millimeters (mm).

2. The box of claim 1, wherein the closing wall has an engagement edge, wherein the at least one upper wall at least partially defines a receiving seat for the engagement edge, and wherein the engagement edge is insertable in the receiving seat for engaging the closing wall to the at least one upper wall.

3. The box of claim 1, wherein the lower wall has a projecting portion, and wherein the closing wall has an engagement edge configured to engage the projecting portion of the lower wall.

4. The box of claim 1, wherein the support profile is made of polyvinyl chloride (PVC), the closing profile is made of PVC, or the support profile and the closing profile are made of PVC.

5. The box of claim 1, wherein the projections are configured to lock a sliding of the support elements along the lower wall.

6. The box of claim 1, wherein each of the support elements has an opening at the base and at a respective slot, and wherein the opening is configured to allow passage of at least one rope of the system for opening and closing the communication route.

7. The box of claim 1, further comprising:

a grip portion fixed to the at least one upper wall and configured to be engaged by an upper element for mating with a frame of a window or of a double pane.

8. The box of claim 1, wherein the separation means comprises a blackout blind, a venetian blind, or a pleated blind.

9. A combination, comprising:

a box having a major extension direction and being defined by a support profile and by a closing profile extending along the major extension direction, a box body having at least one upper wall, a lower wall, a connecting wall, and a closing wall, the connecting wall, at least one upper wall, and lower wall being defined by the support profile, the closing wall being defined by the closing profile, the closing profile being removably fixable to the support profile for closing the box body, the lower wall having a contact edge configured to abut the closing wall, the box further comprising support elements for a movement unit, each of the support elements having a base abutting the lower wall and a projection projecting from the base, the lower wall having a plurality of slots, each of the slots having an open side at the contact edge so as to allow each projection to be inserted in a respective slot from the open side, by moving the projection in a direction toward the connecting wall, when the closing profile is fixed to the support profile, a distance between the closing wall and the connecting wall is equal to or less than 20 millimeters (mm); and a system for opening and closing a communication route between two separate areas, the system comprising separation means suitable for allowing and preventing, respectively, at least partially, crossing of the communication route by light, the movement unit of the separation means between at least a first open position and a second closed position of the communication route; the movement unit insertable in the box body of the box and comprising a roller and/or at least one drum, a plurality of ropes and/or ladders being connected with the separation means and adapted to be rolled on the roller and/or at least one drum.

10. A box for a system for opening and closing a communication route between two separate areas, the system comprising a blind suitable for allowing and preventing, respectively, at least partially, crossing of the communication route by light, the box comprising:

a box body configured to accommodate a movement unit of the system for opening and closing the communication route; and support elements for the movement unit;

wherein the box body has a major extension direction, wherein the box body is defined by a support profile and a closing profile, both profiles extending along the major extension direction, wherein the box body comprises at least one upper wall, a lower wall, a connecting wall, and a closing wall, wherein the support profile defines the at least one upper wall, the lower wall, and the connecting wall, wherein the closing profile defines the closing wall, wherein the closing profile is configured to be removably fixable to the support profile for closing the box body, wherein each of the support elements comprises a base abutting the lower wall and a projection projecting from the base, wherein the lower wall comprises a contact edge configured to abut the closing wall, wherein the lower wall further comprises a plurality of slots, each of the slots having an open side at the contact edge so as to allow a respective projection to be inserted from the open side, by moving the projection in a direction toward the connecting wall, and wherein when the closing profile is fixed to the support profile, a distance between the closing wall and the connecting wall is less than or equal to 20 millimeters (mm).

11. The box of claim 10, wherein the blind comprises a blackout blind, a venetian blind, or a pleated blind.

12. The box of claim 10, wherein the blind comprises a blackout blind.

13. The box of claim 10, wherein the blind comprises a venetian blind.

14. The box of claim 10, wherein the blind comprises a pleated blind.

15. The box of claim 10, wherein the closing wall has an engagement edge, wherein the at least one upper wall at least partially defines a receiving seat for the engagement edge, and wherein the engagement edge is insertable in the receiving seat for engaging the closing wall to the at least one upper wall.

16. The box of claim 10, wherein the lower wall has a projecting portion, and wherein the closing wall comprises an engagement edge configured to engage the projecting portion of the lower wall.

17. The box of claim 10, wherein the support profile is made of polyvinyl chloride (PVC), the closing profile is made of PVC, or the support profile and the closing profile are made of PVC.

18. The box of claim 10, wherein the projections are configured to lock a sliding of the support elements along the lower wall.

19. The box of claim 10, wherein each of the support elements has an opening at the base and at a respective slot, and wherein the opening is configured to allow passage of at east one rope of the system for opening and closing the communication route.

20. The box of claim 10, further comprising:

a grip portion fixed to the at least one upper wall and configured to be engaged by an upper element for mating with a frame of a window or of a double pane.

* * * * *